US007578087B2

(12) United States Patent
Tollis et al.

(10) Patent No.: US 7,578,087 B2
(45) **Date of Patent: *Aug. 25, 2009**

(54) CONSTRUCTION PERMIT STORAGE DEVICE

(75) Inventors: David R. Tollis, 6416 Orchard Oriole La., Bradenton, FL (US) 34202; Lisa Fitzgerald, Sarasota, FL (US)

(73) Assignee: David R. Tollis, Bradenton, FL (US)

( * ) Notice: Subject to any disclaimer, the term of this patent is extended or adjusted under 35 U.S.C. 154(b) by 438 days.

This patent is subject to a terminal disclaimer.

(21) Appl. No.: 11/483,509

(22) Filed: Jul. 10, 2006

(65) Prior Publication Data

US 2008/0016735 A1 Jan. 24, 2008

(51) Int. Cl.
*G09F 7/00* (2006.01)

(52) U.S. Cl. ..... 40/611.07; 40/607.01; 40/611.01; 232/17

(58) Field of Classification Search ..... 40/611.07, 40/607.01, 611.01, 607.03, 312, 606.04, 40/606.05; 232/17; 220/229; 248/224.7
See application file for complete search history.

(56) References Cited

U.S. PATENT DOCUMENTS 2,423,532 A * 7/1947 Travis ..... 232/17
4,821,440 A 4/1989 Dunn
5,529,173 A 6/1996 Salacuse
5,623,778 A 4/1997 Dunn
5,664,851 A 9/1997 Dunn
5,800,027 A 9/1998 Dunn
6,012,786 A 1/2000 Dunn
6,070,744 A 6/2000 Levinson
D430,216 S 8/2000 Dunn
6,618,974 B2 9/2003 Szalay
7,055,272 B2 6/2006 Tollis

* cited by examiner

*Primary Examiner*—Cassandra Davis
(74) *Attorney, Agent, or Firm*—Charles J. Prescott

(57) ABSTRACT

A weather resistant construction site document storage apparatus including an outer enclosure having a front, a back, two spaced side and top panels formed as a single weather-sealed unit having an open bottom thereof. An inner document frame has a top, two spaced side, and back panels, all of which are formed as a single unit. A document retaining panel is connected to, and upwardly extends from, the bottom panel of the inner frame to define a trough, a remainder of a front surface of the inner frame being rearwardly displaced adjacent the back panel to provide an open interior volume for document placement. The outer enclosure is sized for close non-binding sliding engagement over the inner frame to cover the open front surface and to weather protect documents placed into the interior volume. Mating sliding engagement between the inner frame and the outer enclosure allow the outer enclosure to be slidably lifted upwardly and releasably held thusly for document placement and removal.

2 Claims, 12 Drawing Sheets

CONSTRUCTION PERMIT STORAGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates generally to document storage and display apparatus and more particularly to a weather resistant construction site documentation storage apparatus which is affixed to a support structure at a building or home construction site.

2. Description of Related Art

Documents related to a home or building construction site such as building permits and drawings must be kept in a weather resistant storage apparatus at each such construction site. Construction site storage apparatus are typically fastened to a tree or to an upright wooden board member which is driven into the ground. Inspectors and contractors routinely place documents into these storage apparatus and remove them therefrom as required during construction. An inspector may visit a construction site numerous times and require access to the building construction drawings while the public at large is placed on notice as to the details of the construction as set forth in the building permit which is also stored within the document storage apparatus.

Several environmental restrictions or requirements are placed upon such construction site document storage apparatus, namely the wear and tear they must undergo at a construction site and their weather-tight design structure required to insure that the documents placed therewithin are not ruined with rainwater intrusion or blown from the storage apparatus should the openable feature thereof become disengaged during high wind conditions.

Gary Dunn has brought his inventiveness to bear as set forth in numerous patents issued to him. One such disclosure in U.S. Pat. No. 4,821,440 teaches such a construction site document disclosure apparatus having a back frame having a U-shaped curl at each outer edge of its top and bottom sides and a four-sided hinged cover which engages in flush fashion therewith to prevent water access into the interior of the apparatus. In U.S. Pat. No. 5,623,778, Dunn teaches a weatherized posting board assembly having a back frame and a front cover of unitary construction for the posting and removal of documents to be posted therein. In U.S. Pat. No. 5,664,851, Dunn there teaches another document display case for displaying construction permits and the like, the weather resistant case having a base member and a door hinged thereto and also providing a tack board mounted to the rear wall of the base member for supporting displayed documents. A transparent window in the door permits viewing of the documents directly.

Dunn further teaches in U.S. Pat. No. 5,800,027 a brochure display case for displaying and dispensing promotional literature, business cards and the like at unattended sites. In U.S. Pat. No. 6,012,786, Dunn has disclosed still another construction site display and storage case which is weather resistant and ventilated. A unique notch and slot structure is adapted for attachment of the device to either an upright or a horizontal board support member. The design features of a permit box are also taught by Dunn in U.S. Design 430,216.

Other related prior art known to applicant are taught in U.S. Pat. No. 5,529,173 by Salacuse teaching a convertible container and frame having two panels hingedly connected together and, when open, providing a double length framed area. Levinson, in U.S. Pat. No. 6,070,744 teaches another display unit for attachment to a supporting surface and including downwardly extending document display holder panels pivotally attached to a support member. In U.S. Pat. No. 6,618,974, Szalay teaches a message display apparatus including a frame with spaced side rails which slidably receive a pair of covers, one of which is visibly clear for viewing documents and protecting them from weather conditions.

U.S. Pat. No. 7,055,272 provides a weather resistant construction site document storage apparatus having uniquely configured inner document frame and outer enclosure aspects which slidably engage vertically one to another to provide access for placement and removal of documents when the outer enclosure is in a temporarily fixed upward position. The inner document frame is attachable to either a tree or other timber support member or to a uniquely configured elongated T-shaped support member which is securely engageable into the ground. A separate front document enclosure attachable to the front panel of the outer enclosure is also provided and is preferred. representing substantial functional, manufacturing and cost improvements over the '272 teaching.

BRIEF SUMMARY OF THE INVENTION

This invention is directed to a weather resistant construction site document storage apparatus comprising an elongated outer enclosure having a front panel, a back panel, two spaced side panels and a top panel, all of which are formed as a single weather-sealed unit having an open bottom thereof. An elongated inner document frame has a top panel, two spaced side panels, and a back panel, all of which are formed as a single unit. A shortened-in-height document retaining panel is connected to, and upwardly extends from, the bottom panel of the inner frame to define a trough, a remainder of a front surface of the inner frame being rearwardly displaced against the back panel to provide a substantially open interior volume to place documents into the trough. The outer enclosure is sized for close non-binding upward and downward sliding engagement over the inner frame to cover the open front surface and to weather protect documents placed into the interior volume. Mating sliding engagement between the inner frame and the outer enclosure allow the outer enclosure to be slidably lifted upwardly and releasably held thusly for document placement and removal.

It is an object of this invention to provide a weather tight construction site permit and document storage apparatus which is attachable to an upright support member at a construction site.

Another object of this invention is to provide an economically constructed and durable weather resistant construction site document storage apparatus which is easily attachable either to a tree, an upright board having been anchored into the ground or to a uniquely configured support member which is also anchorable into the ground.

Still another object of this invention is to provide a weather resistant construction site document storage apparatus providing for a weather tight storage area for construction permits and other documents and for construction blueprints and site drawings, permits and other smaller documents.

A yet further object of this invention is to provide a weather resistant construction site document storage apparatus that may be mounted and moved without the need for tools.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
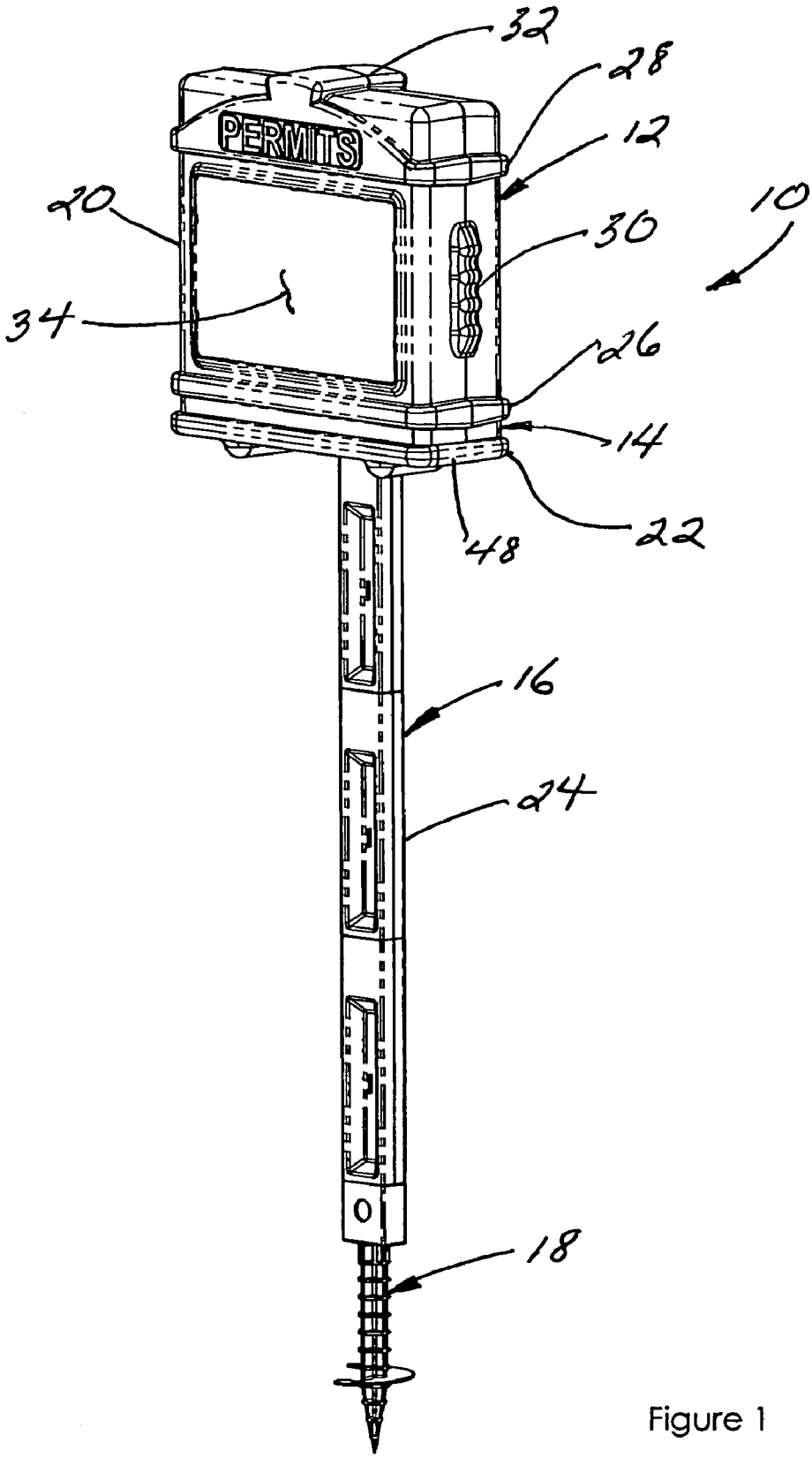
FIG. 1 is a perspective view of the invention.
Figure 2:
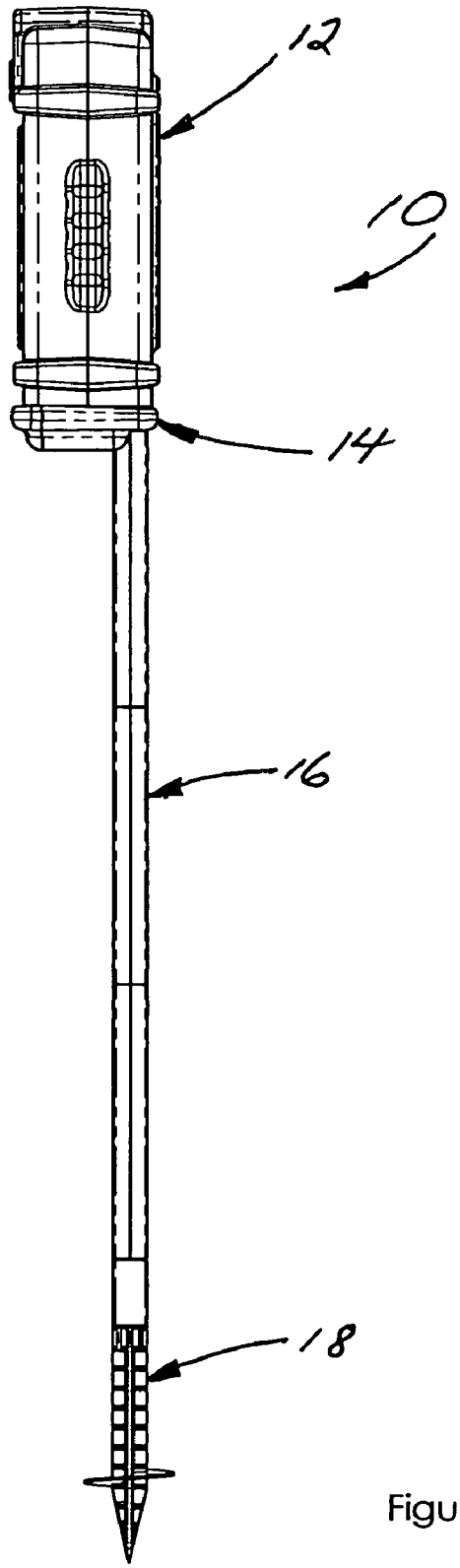
FIG. 2 is a right side elevation view of FIG. 1.
Figure 3:
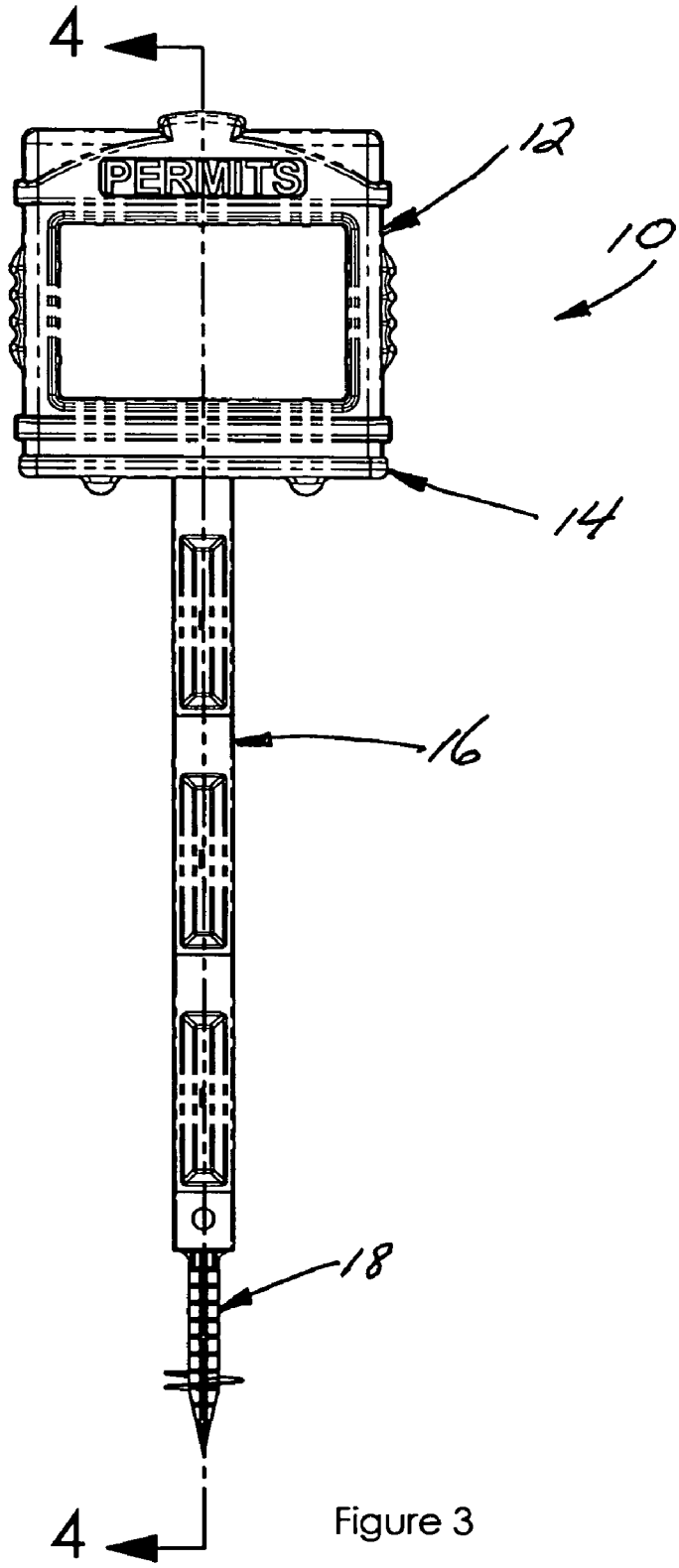
FIG. 3 is a front elevation view of FIG. 1.

Referring now to the drawings, the preferred embodiment of the invention is there shown firstly in FIGS. 1 to 4 at numeral 10. This document storage apparatus 10 preferably includes an outer enclosure 12, an inner document receiving frame 14, an upright stanchion assembly 16, and a ground engaging tip 18. The outer enclosure 12 is preferably formed of thin thermoplastic material utilizing blow mold manufacturing techniques. Likewise, the inner frame 14 is also formed of thin walled thermoplastic material utilizing blow mold manufacturing techniques. The net result is that the outer housing 20 and the inner housing 22 are extremely light and economical to manufacture and weather-resistant while maintaining the necessary strength and dimensional consistency to support the functionality of the invention as will be described herebelow.

Figure 5:
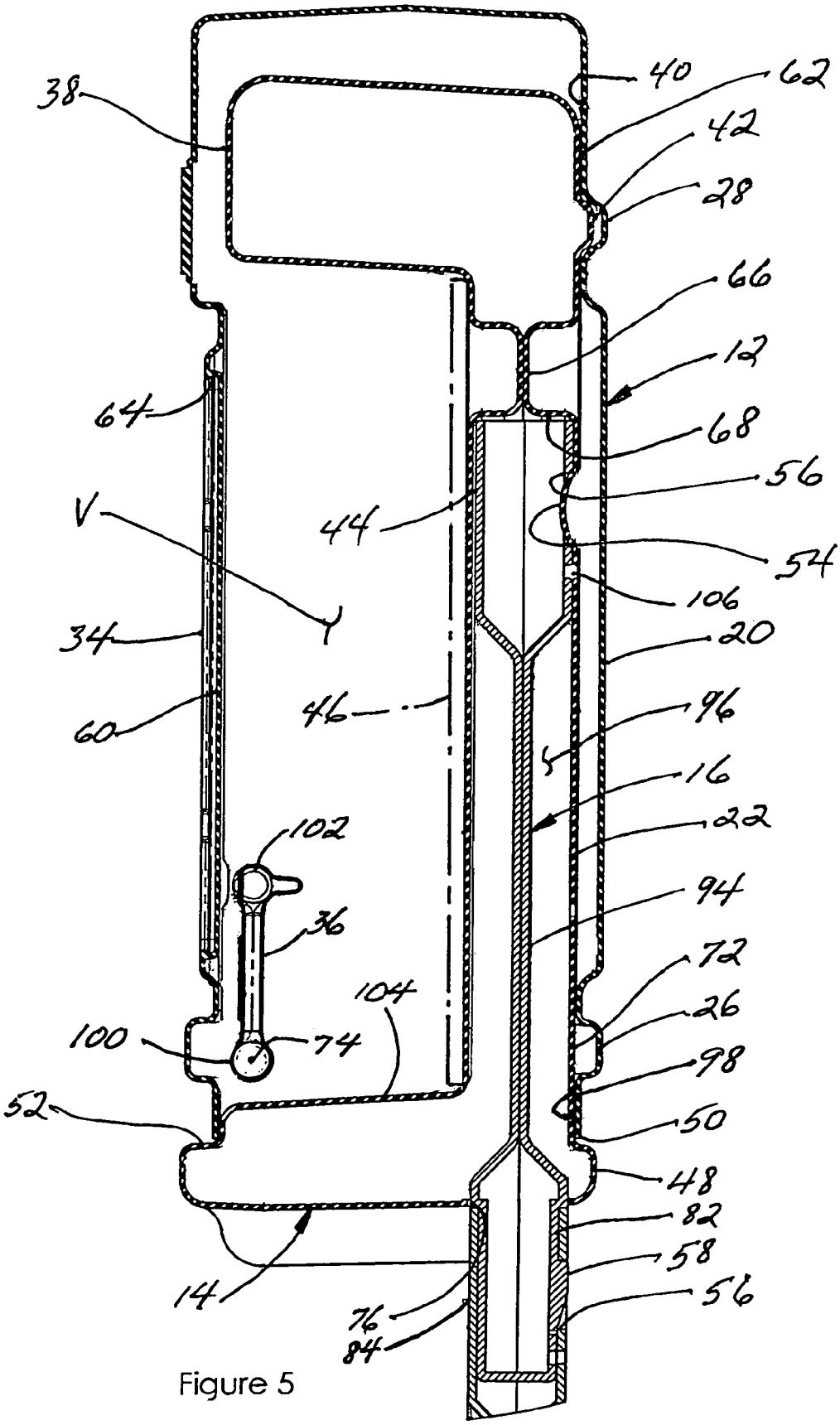
FIG. 5 is an enlargement of area 5 of FIG. 4.
Figure 7:
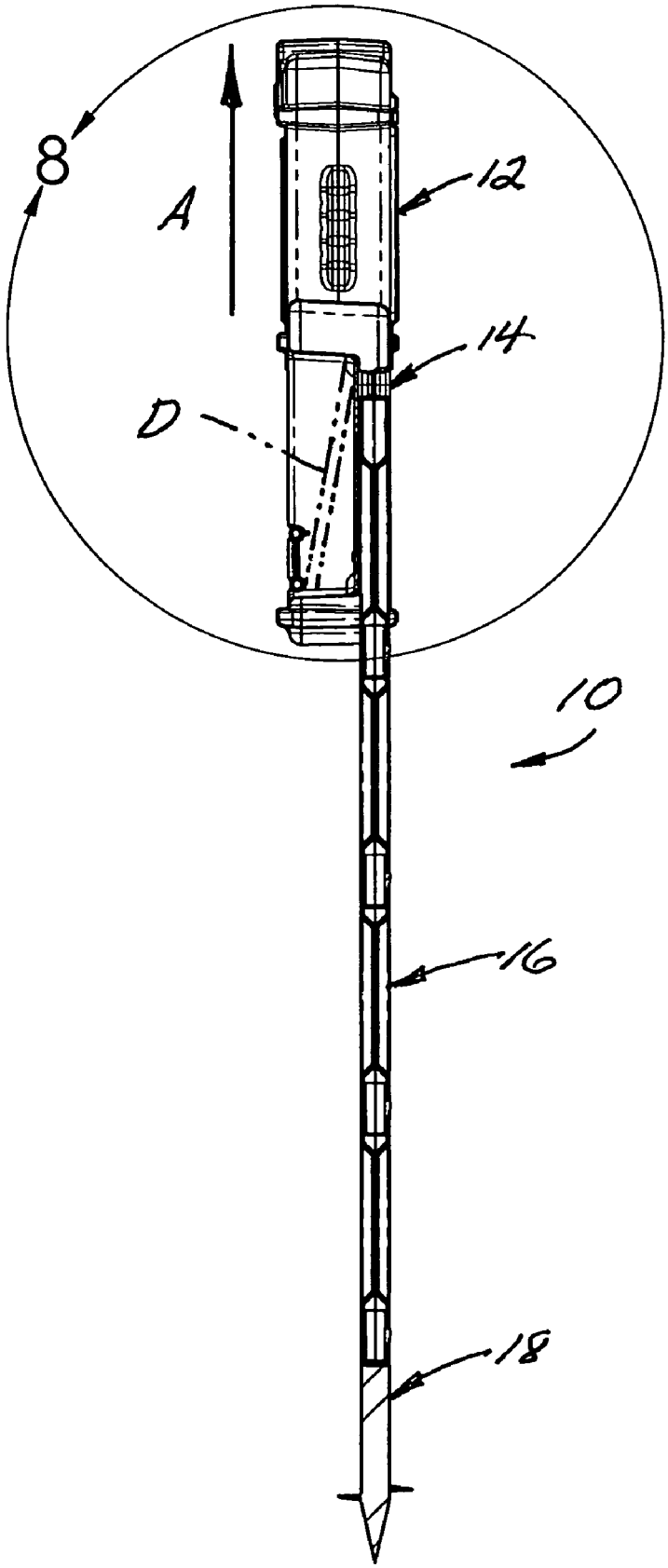
FIG. 7 is a section view in the direction of arrows 7-7 of FIG. 6.
Figure 8:
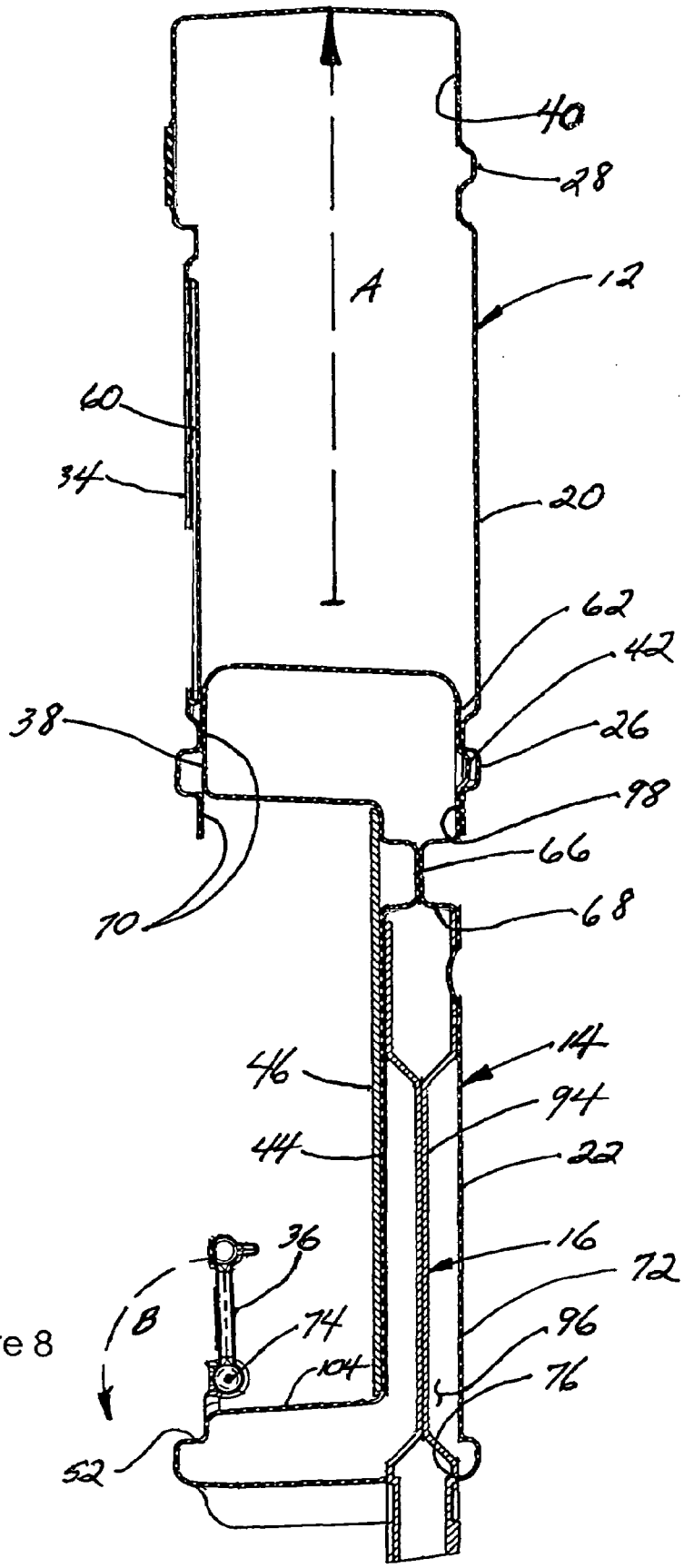
FIG. 8 is an enlargement of area 8 of FIG. 7.
Figure 9:
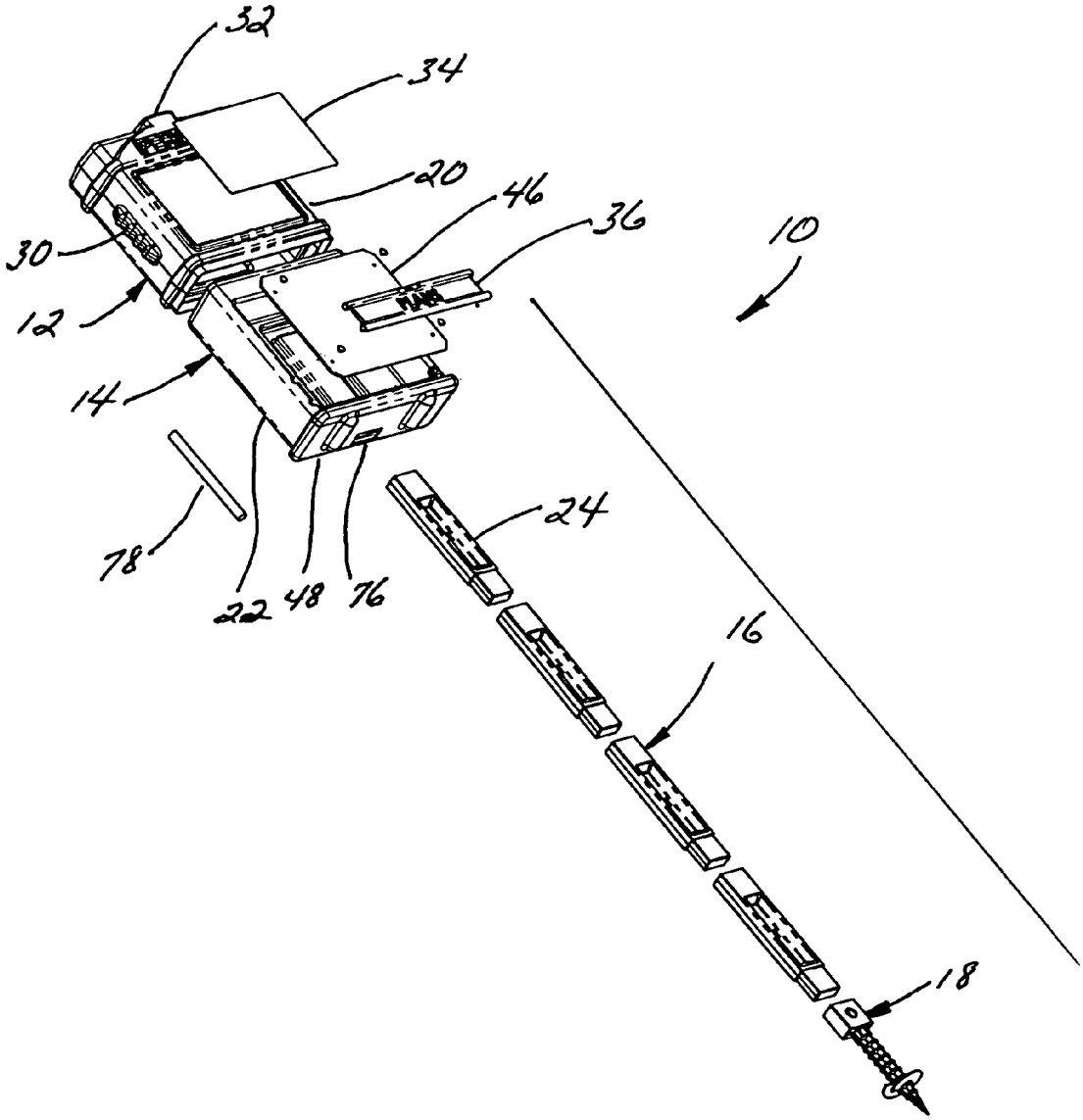
FIG. 9 is an exploded frontal perspective view of the invention.

The outer housing 20 is completely enclosed on the side panels, end panels, and top panel, while leaving the bottom margin 50 in FIG. 5 completely open. The inner housing 22 includes an enlarged in depth upper portion having generally parallel front and back sliding surfaces 38 and 62 and an enlarged in depth lower portion defining a ledge 52 as seen in FIGS. 5 and 8 which slidably receives and supports the open lower margin 50 of the outer housing 20. The main central portion of the inner housing is narrower in depth and rearwardly displaced as defined by front panel 44 and a back sliding panel 72. As seen in FIGS. 7 and 8, the outer housing 20 is slidably movable upwardly in the direction of arrow A with respect to the lower housing 22. Mating sliding surfaces 38/70, 62/(40, 98), and 72/98 serve to insure that the upward sliding movement of the outer housing 20 in the direction of arrow A (and then downward movement) is smooth and stable.

A display panel 46 is attached against the inner housing front panel 44 to display desired construction and advertising information while a name plaque 34 is attached against the outer housing front panel 60 by mechanical fastening means, the alignment margin 64 serving to protect the edges of the name plaque 34.

Figure 4:
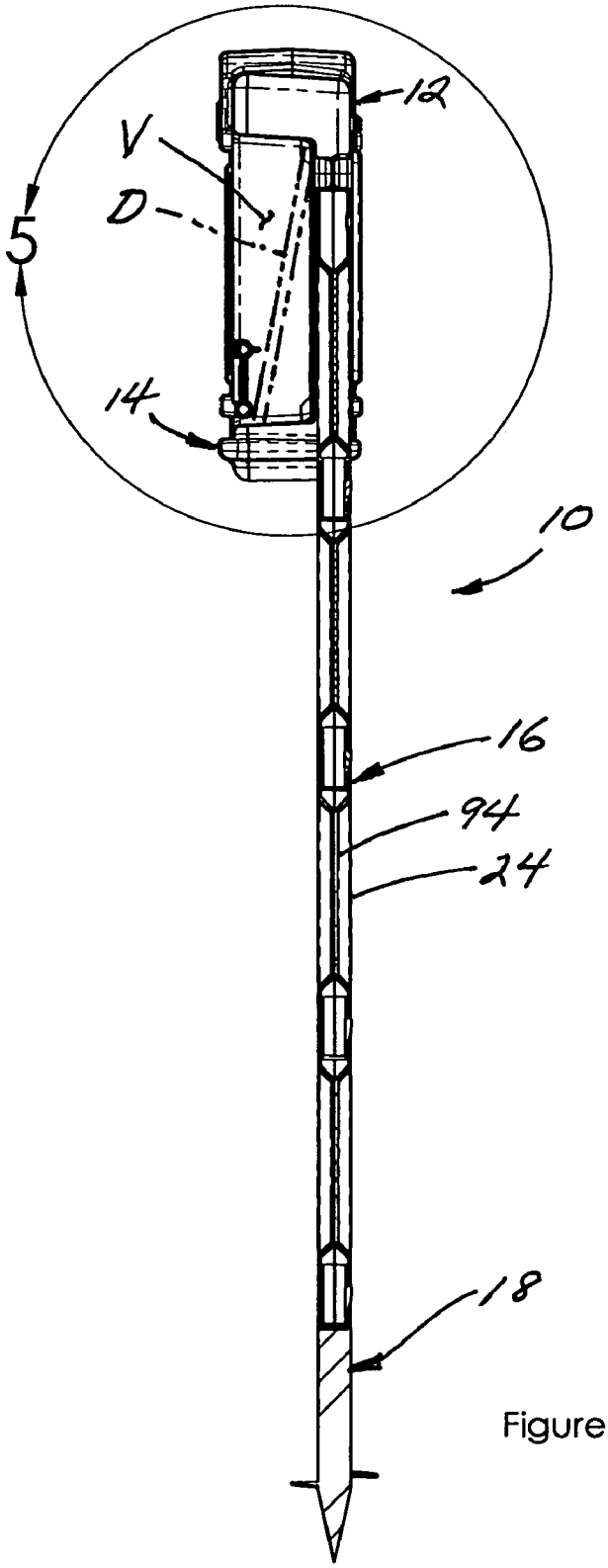
FIG. 4 is a section view in the direction of arrows 4-4 in FIG. 3.

When the outer housing 20 is in the closed downward position seen in FIGS. 1 to 5, a closed, substantially watertight interior volume V is defined into which construction documents, permits and the like shown generally at D in FIGS. 4 and 7, are protected. This interior volume V is defined between the recessed inner housing front panel 44 and the outer housing front panel 60. Because the entire outer surface of the outer housing 20 is watertight and formed as a unit of thermal plastic sheet material by the blow mold process, when the lower open margin 50 is slidably engaged against the L-shaped perimeter ledge 52 as best seen in FIG. 5, the entire interior volume V is substantially sealed and weather tight.

When the inner and outer housing 22 and 20, respectively, are in the closed position, a rearwardly extending upper locking rib 42 biasingly engages into an upper locking groove 28 formed along the upper back surface of the outer housing 20. This biased engagement is overcome by the lifting force exertable by grasping and upwardly lifting the outer housing 20 in the direction of arrow A. When upward movement of the outer housing 20 reaches its maximum open limit as best seen in FIG. 8, a lower locking groove 26, formed adjacent the lower margin 50 of the outer housing 20, biasingly engages over the upper locking rib 42 to maintain this open orientation of the outer housing 20. Documents may then be placed into, or removed from, the now open interior volume V and resting atop surface 104 and held in place by the upright closed position of the retaining panel 36.

Figure 6:
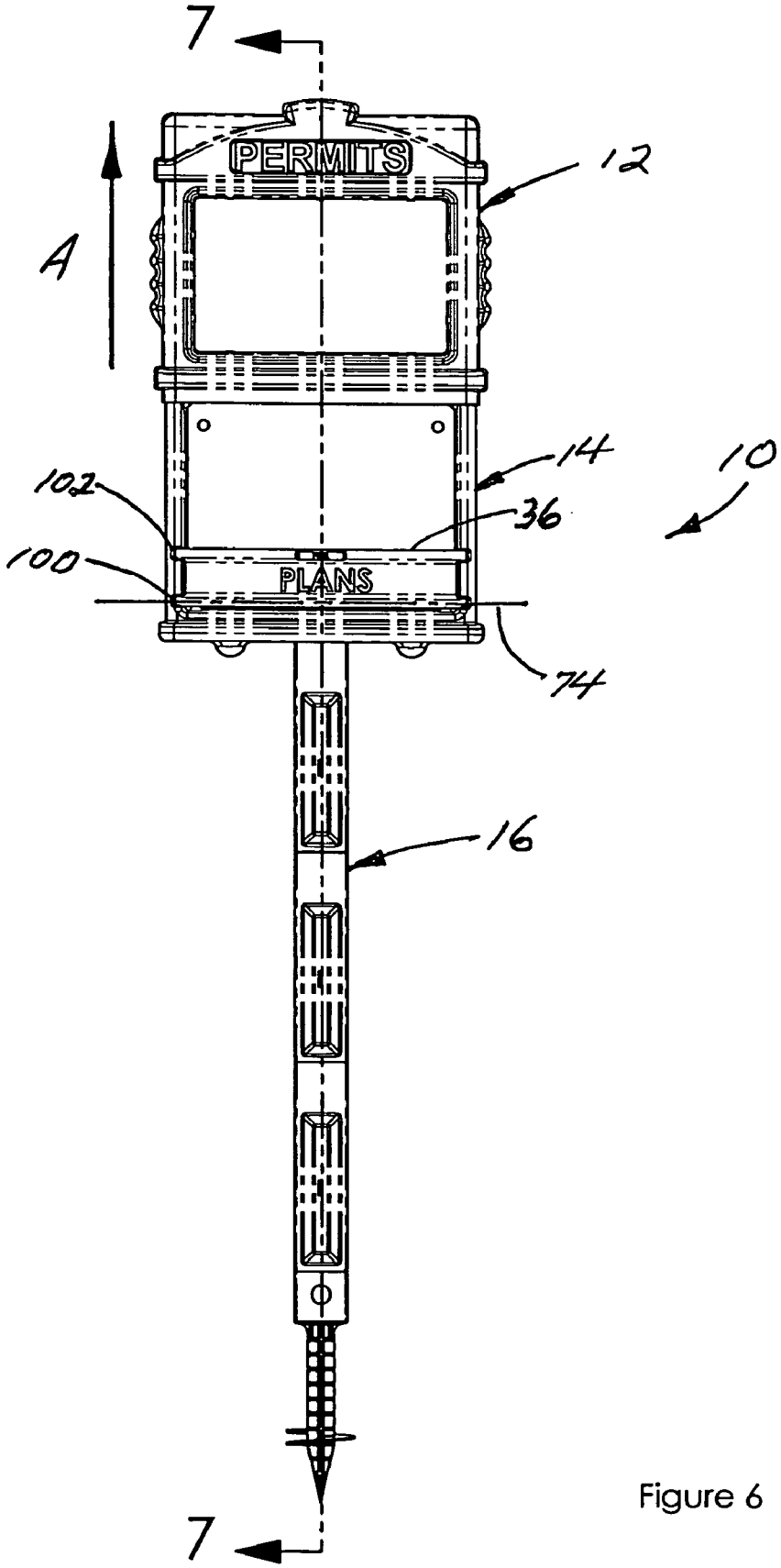
FIG. 6 is a front elevation view of FIG. 1 showing the invention in an opened position.

As best seen in FIGS. 4, 5, 7 and 8, the documents D rest atop the rearwardly extending lower surface 104 of the inner housing 22 and typically and are held thusly by a document retaining panel 36 which forms a trough-like structure. After the outer housing 20 is slid upwardly in the direction of arrow A by either grasping the gripping ribs 30 or the lifting cap 32, the retaining panel 36, pivotally held about pivotal axis 74 by pivot shafts 100 at each lower end thereof, may be pivoted outwardly in the direction of arrow B in FIG. 8 to facilitate removal of these documents D. In the upright closed position, the retaining panel 36 is held thusly by the biased snapping engagement of the retaining tabs 102 as best seen in FIG. 6 into mating cavities formed into the upright side margins of the inner housing 22.

An upper stanchion support cavity 96 as best seen in FIGS. 5 and 8, is defined between the interior surfaces of the front panel 44 and the back sliding panel 72 of the inner housing 22. A stanchion receiving aperture 76 is formed into the bottom surface of the inner housing 22 in alignment with this cavity 96 so that the upper one of a plurality of stanchion elements 16 which are connected in end-to-end fashion as described herebelow, may be inserted upwardly thereinto. The top surface 68 of this support cavity 96 abuts against the upper end of the stanchion assembly 16 in concert with the biased interengagement which occurs between a resilient protruding retaining button 54 formed centrally into the back sliding panel 72 and a stanchion retaining aperture 56 formed centrally adjacent the upper end of each of the stanchion elements 24 as best seen also in FIG. 11.

Each stanchion element 24 is also preferably formed of thin-walled thermoplatsic material utilizing blow mold manufacturing techniques and includes a central web area 94 wherein the front and back panels are formed together and may be thermally bonded during the manufacturing process for additional strength therebetween. After the stanchion assembly 16 is secured in the position shown within support cavity 96, an additional retaining fastener aperture 106 is provided for installing a threaded fastener (not shown) to prevent removal of the stanchion assembly 16 therefrom.

Each stanchion element lower end 82 is reduced in size so as to matably engage into the hollow upper end 86 of the next stanchion element 24 and lockable engagement is effected by a locking tab 58 snapably engaging into the mating and aligned retaining aperture 56 of the next adjacent stanchion element 24.

It is here noted that, although the multiple element stanchion assembly 16 is preferred for longevity, strength and height versatility and in facilitating coupling connection to the ground-engaging tip 18 described more fully herebelow, nonetheless the stanchion-receiving aperture 76 and the support cavity 96 as best seen in FIG. 5, are sized to also receive a conventional wooden 2×4 beam in lieu thereof. Such a wooden 2×4 beam serving as a stanchion may be embedded into the ground or attached to a building or a tree for support.

Turning particularly to FIGS. 9 to 16, details of the ground-engaging tip 18 are there shown. This ground-engaging tip 18 is preferably mold formed of thermoplastic material and includes a hollow upwardly open upper end 86 having opposing aligned locking apertures 88 formed through the side walls thereof which lockingly engage with the locking tab 58 formed at the lower end of each stanchion element 24 as previously described. The main shaft 84 of ground-engaging tip 18 is ribbed for strength and economy of material. The lower end 90 is pointed for initial ground penetration which may be facilitated by stepping on the ground screw plate 92 or simply stepping on the upper end of the ground-engaging tip 18.

Figure 14:
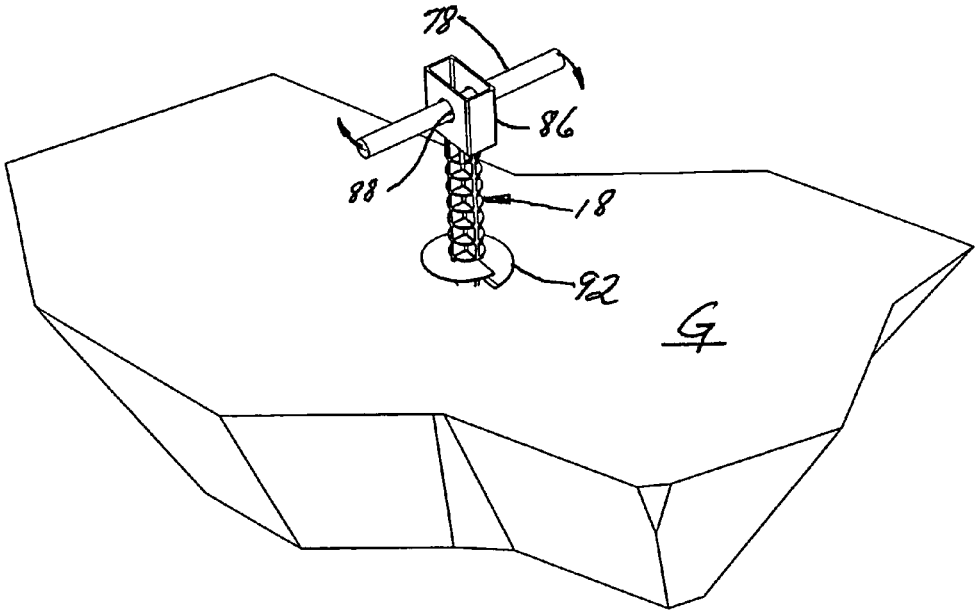
FIG. 14 is a perspective view of the ground-engaging lower tip of the upright stanchion being driven into the ground.
Figure 15:
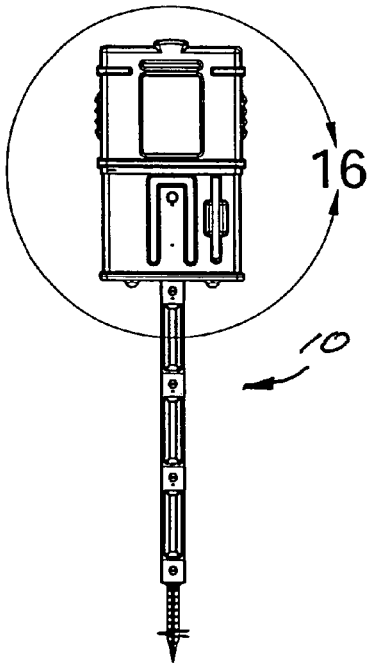
FIG. 15 is a simplified rear elevation view of the invention.

As best seen in FIG. 14, once the pointed tip 90 has penetrated into the ground sufficiently for the ground screw plate 92 to contact the ground, an elongated handle 78 may be temporarily inserted through the aligned locking apertures 88 and then hand-grasp to turn the ground engaging tip 18 in the direction of the arrows so as to cause the ground screw plate 92 to draw the ground-engaging tip 18 deeply into the ground for full, positive securement thereof. Thereafter, the desired number of stanchion elements 24 may be connected end-to-end as previously described to establish a proper viewing and use height for the entire storage apparatus 10.

Figures 10, 11:
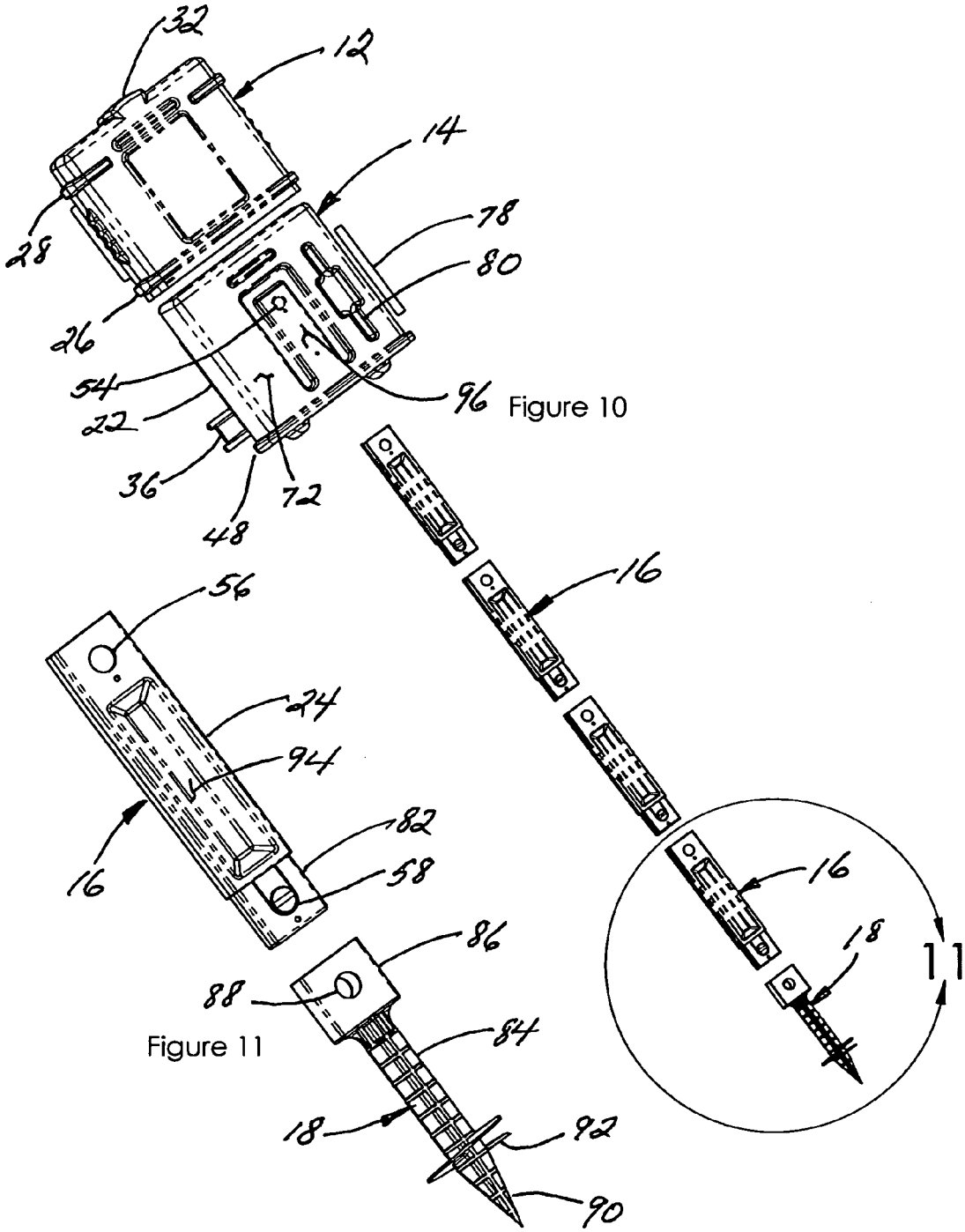
FIG. 10 is an exploded rear perspective view of the invention.
FIG. 11 is an enlargement of area 11 in FIG. 10.
Figure 12:
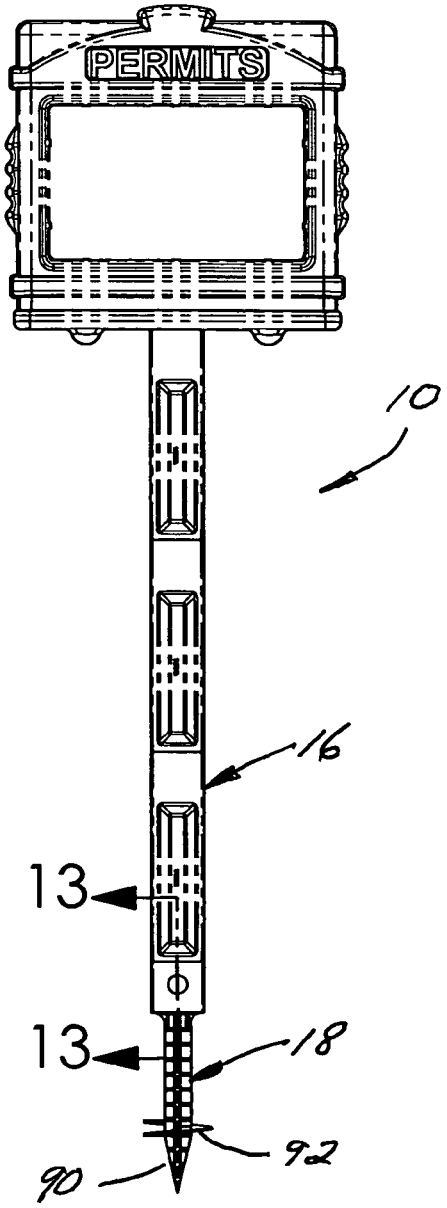
FIG. 12 is another front elevation view of the invention.
Figure 13:
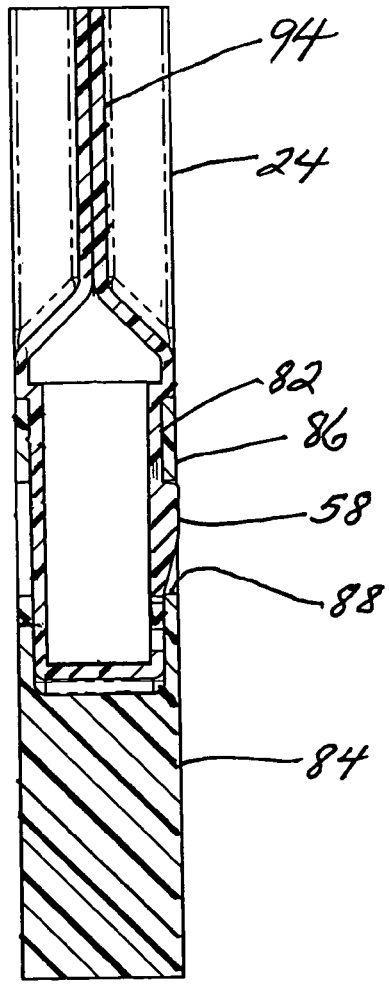
FIG. 13 is a section view in the direction of arrows 13-13 in FIG. 12.
Figure 16:
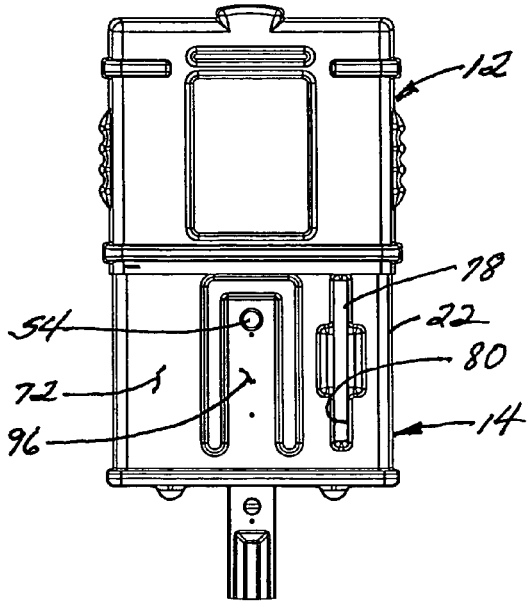
FIG. 16 is an enlargement of area 16 of FIG. 15 showing the invention in an opened position.

Storage of the handle 78 is provided by snapping engagement into a mating handle storage cavity 80 formed into the back panel 72 of the inner housing 22 as best seen in FIGS. 10 and 16.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is

1. A weather resistant construction site document storage apparatus comprising:

an elongated outer enclosure having a front panel, a back panel, two spaced side panels and a top panel, all of which are formed as a single molded unit having an open bottom thereof;

an elongated inner document frame having a top panel, two spaced side panels, a back panel and a bottom panel, all of which are formed as a single molded unit, and a document retaining panel connected to, and upwardly extending from, a front margin of said bottom panel to define a trough, a remainder of a front area of said inner frame being substantially open for document placement into, and removal from, said trough;

said outer enclosure sized for close upward and downward sliding engagement over substantially all of said inner frame to cover said open front surface and to weather protect documents placed into said trough;

mating said side, front, and back panels of said outer enclosure and said inner frame slidably mating wherein, when said outer enclosure is slidably lifted upwardly with respect to said inner frame but not removable therefrom, access is provided for document placement and removal from said trough; and an elongated stanchion lockingly connectable at an upper end thereof into a mating support cavity formed between said front and back panels of said inner frame; a ground engaged tip connected at a lower end of said stanchion.

2. A weather resistant construction site document storage apparatus comprising:

an elongated outer enclosure molded as a unit of thin plastic material and having generally rectangular front, back, side and top panels and an open bottom thereof;

an elongated inner document frame having generally rectangular top, side, bottom and back panels, all of which are formed as a single unit, and a document retaining panel pivotally connected to, and upwardly extending from, said bottom panel to define a trough, a remainder of a front surface of said inner frame being rearwardly recessed to allow documents to be placed into, and removed from said trough;

said outer enclosure sized for close upward and downward sliding engagement over substantially all of said inner frame to form an interior volume with said front surface to weather protect documents placed into said trough;

a mating groove and rib arrangement positioned between said outer enclosure and said inner frame releasably retaining said outer enclosure in an open upward position with respect to said inner frame wherein access is provided for document placement and removal from said trough and in a closed downwardly position enclosing said inner housing to protect documents placed into said interior; and an elongated stanchion lockingly connectable at an upper end thereof into a mating support cavity formed between said front and back panels of said inner frame; a ground engaging tip connected at a lower end of said stanchion.

* * * * *

UNITED STATES PATENT AND TRADEMARK OFFICE

CERTIFICATE OF CORRECTION

PATENT NO. : 7,578,087 B2
APPLICATION NO. : 11/483509
DATED : August 25, 2009
INVENTOR(S) : David R. Tollis et al.

It is certified that error appears in the above-identified patent and that said Letters Patent is hereby corrected as shown below:

Column 6, line 57, insert --volume-- after "interior".

Signed and Sealed this

Twenty-fourth Day of November, 2009

David J. Kappos

David J. Kappos
*Director of the United States Patent and Trademark Office*